US005194213A

United States Patent [19]

Diaz et al.

[11] Patent Number: 5,194,213

[45] Date of Patent: Mar. 16, 1993

[54] COPPER SMELTING SYSTEM

[75] Inventors: Carlos M. Diaz, Mississauga; Malcolm C. E. Bell, Oakville, both of Canada

[73] Assignee: Inco Limited, Toronto, Canada

[21] Appl. No.: 875,063

[22] Filed: Apr. 28, 1992

Related U.S. Application Data

[63] Continuation-in-part of Ser. No. 737,217, Jul. 29, 1991.

[51] Int. Cl.[5] ..... C21B 7/00

[52] U.S. Cl. ..... 266/142; 75/640; 75/645; 266/168

[58] Field of Search ..... 266/142, 168; 75/645, 75/640

[56] References Cited

U.S. PATENT DOCUMENTS

| | | | |
|---|---|---|---|
| 2,668,107 | 2/1954 | Gordon et al. | 75/74 |
| 3,281,236 | 7/1964 | Meissner | 75/73 |
| 3,664,828 | 5/1972 | Worner | 75/645 |
| 4,144,055 | 3/1979 | Petersson | 75/640 |
| 4,349,383 | 9/1982 | Chaudhuri | 75/640 |
| 4,830,667 | 5/1989 | Marcuson et al. | 75/76 |
| 5,007,959 | 4/1991 | Reist et al. | 75/645 |

FOREIGN PATENT DOCUMENTS

| | | | |
|---|---|---|---|
| 1247373 | 12/1988 | Canada | 39/3 |

OTHER PUBLICATIONS

Munoz et al., "Codelco-Chile: A Realistic Way to Increase Copper Smelting Capacity," Copper Smelting Update, Metallurgical Society of AIME, pp. 143-163 (1982).

*Primary Examiner*—Peter D. Rosenberg
*Attorney, Agent, or Firm*—Blake T. Biederman; Edward A. Steen

[57] ABSTRACT

A system for continuous smelting of sulfidic copper concentrate in which an oxygen flash furnace is operatively connected with a continuous converter and the continuous converter is operatively connected with a finishing furnace.

5 Claims, 1 Drawing Sheet

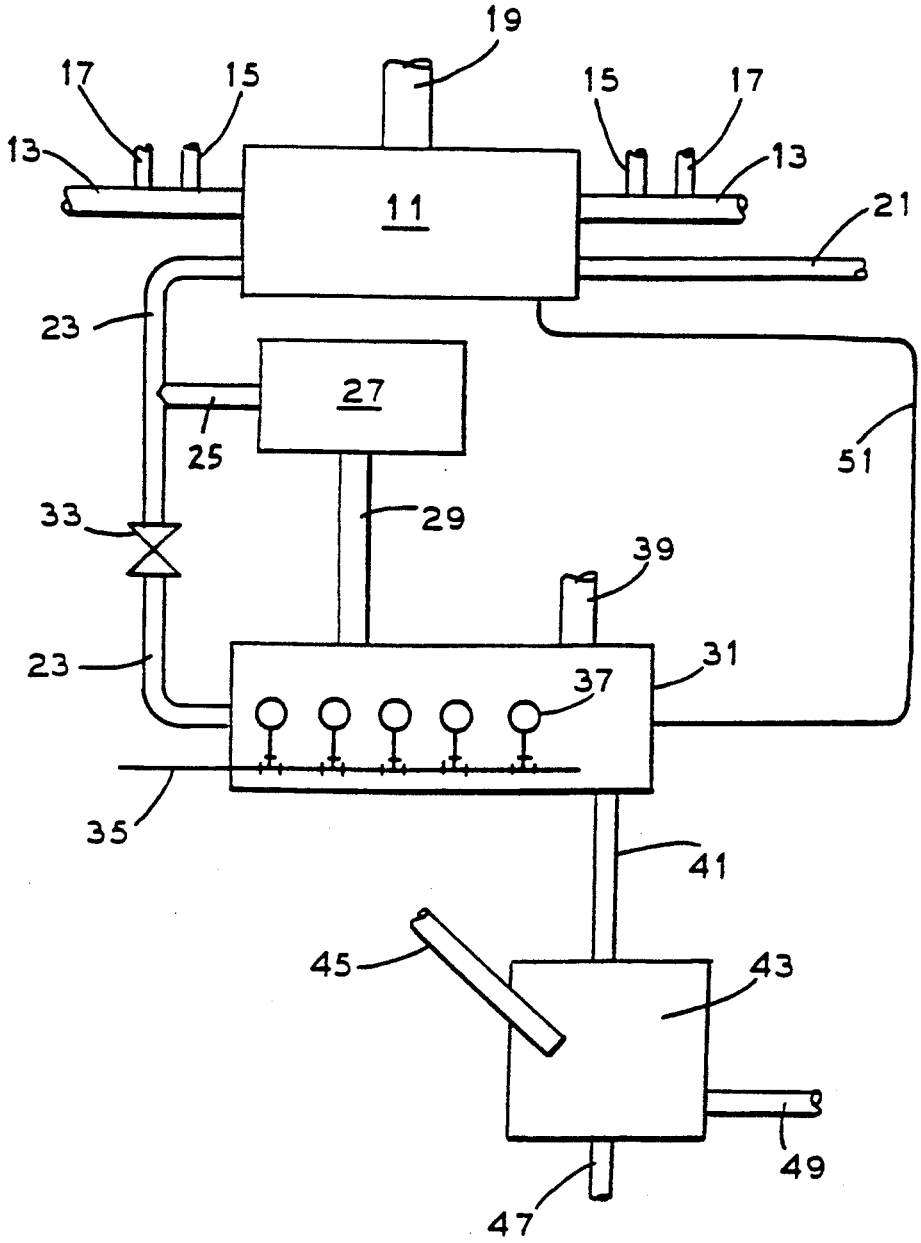
19
17
15
15
17
13
13
11
21
23
27
25
51
33
29
39
23
31
37
35
41
45
43
49
47

COPPER SMELTING SYSTEM

This is a continuation-in-part of copending application(s) Ser. No. 07/737,217 filed on Jul. 29, 1991.

The present invention is concerned with a system for copper smelting and particularly with respect to a continuous system for smelting sulfidic copper ores.

BACKGROUND OF THE INVENTION

Copper in more or less pure forms has been produced for thousands of years in various parts of the world. Many industrial schemes have been employed to produce copper and many more schemes have been proposed for copper production. Even so, there is still a need for improved more efficient methods for production of this industrially essential metal which methods not only provide efficiency in production, but which also minimize damaging pollution.

BRIEF DESCRIPTION OF THE DRAWING

The FIGURE of the drawing is a schematic depiction of an arrangement of equipment employable in the smelting system of the present invention.

DESCRIPTION OF THE INVENTION

The present invention has as its object the provision of a novel continuous system of copper smelting, converting and finishing in which copper sulfide ore concentrate is processed to produce anode quality copper together with a discardable iron silicate slag and off-gas rich in sulfur dioxide and suitable for conversion to liquid sulfur dioxide, elemental sulfur or sulfuric acid.

In the first step of the proposed continuous system the copper sulfide ore concentrate is flash smelted with a siliceous flux. V/hen copper matte in the flash furnace is built up to a steady state level, it is removed on a continuous or discontinuous basis from the flash furnace and advantageously divided into two streams. The first stream is solidified, advantageously by granulation and the second stream is maintained molten. Under conditions specified hereinafter, only one stream of matte passing through the solidification process may be used.

The solid matte is then fed on a continuous basis to a converter vessel fitted with oxidant gas injectors. This converter vessel contains molten white metal, molten semi-blister copper and silicious slag. The converter is operated in such fashion that in-coming matte is oxidized continuously by oxidant gas, e.g. air. Slag is transferred to the flash furnace either on a continuous or intermittent basis and additional silica flux is added to the converter as make up.

As the amount of semi-blister copper builds up in the converter it is transferred to a finishing furnace, advantageously a finishing furnace equipped with an oxygen lance means and a means for stirring molten copper by bubbling inert gas, e.g. nitrogen from the bottom of the furnace. The oxygen lance means can be modified to lance reductive gas onto a copper bath which has been oxidized excessively. The product of the finishing furnace is solidified producing copper suitable for further refining, for example, by electrorefining. A very small amount of slag produced by the finishing furnace is transferred either to the converter or the flash furnace.

Basic to the system of the present invention is the converter which advantageously can be a modified Peirce-Smith converter or an El Teniente converter, both of which are fitted with sub-surface oxidant gas injectors, i.e. gas injector positioned during operation below the surface of molten material in the converter. These injectors can be normal tuyeres when air or slightly oxygen-enriched air is used as the oxidant gas. If highly enriched air or commercial oxygen is used as the oxidant gas either shrouded or other specially designed tuyeres must be used or the converter vessel must be adapted to incorporate an oxygen lance or lances. In accordance with the invention, when air or slightly oxygen-enriched air is used as the oxidant in the converter, the heat balance of the converter necessary to maintain the contents molten and to continue oxidation of matte is ordinarily controlled by intermittently feeding molten matte to the converter. This feeding of molten matte is the reason for providing two matte product streams from the flash furnace. However, if the converter is adapted to employ highly enriched air or oxygen as the oxidant, then only solid matte need be fed to the converter, thus effectively decoupling the smelting and converting operations and completely eliminating the transfer of molten matte. Means are provided for adjusting the ratio of solid to liquid matte fed to the converter in accordance with the degree of oxygen enrichment of the oxidant gas in the converter.

PARTICULAR DESCRIPTION OF THE INVENTION

The system of the present invention is depicted in the drawing in which flash furnace 11 having oxygen feed lines 13, sulfide concentrate feed lines 15 and flux (silica) feed lines 17 is employed to produce copper matte and slag by autogenous oxidation sulfide concentrate. Product gas rich in sulfur dioxide is removed through gas port 19 to a $SO_2$ recovery system not shown. Product slag suitable for discharge is removed through line 21.

Product matte is transferred through line 23 and branch line 25 to granulator 27 and solidified matte is fed through line 29 to converter 31. Intermittently molten matte is permitted to pass directly through line 23 to converter 31 by opening means 33. Converter 31 is equipped with oxidant gas line 35 connected to a plurality of tuyeres 37. The molten materials present in converter 31 are essentially slag, white metal (roughly $Cu_2S$) and semi-blister copper. Matte entering converter 31 is rapidly oxidized by oxidant gas entering tuyeres 37 with product gas exiting port 39 and proceeding to the $SO_2$ recovery system. Molten semi-blister copper passes through line 41 to finishing vessel 43 fitted with oxygen lance 45, inert gas stirrer 47 and product exit line 49. Slag from converter 31 passes through line 51 to flash furnace 11.

Equipment comprising individual items of the system of the invention is generally known in the art. A flash furnace suitable for use in the system of the present invention is disclosed in U.S. Pat. No. 2,668,107. Converters which can be employed include modified Peirce-Smith converters which are adapted to receive a continuous feed of solid copper matte and deliver continuously or intermittently semi-blister copper product. Feeding a stream of solid matte into a converter is disclosed in U.S. Pat. No. 5,007,959. Slag removal from such modified converters can be continuous or intermittent. A diagram of a suitably modified El Teniente converter is contained in the article "Codelco-Chile:A Realistic Way to Increase Copper Smelting Capacity", Munoz et al in the book Copper Smelting An Update, edited by George Taylor, and AIME publication ©1981. A suitable copper finishing furnace is disclosed in principle in U.S. Pat. No. 4,830,667.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A copper smelting system comprising:

a) an oxygen flash furnace for oxidizing copper sulfide concentrates in the presence of silica flux to form molten copper matte and a discardable molten silicate slag;

b) a converter vessel fitted with oxidant gas injectors and containing molten siliceous slag, molten white metal and molten semi-blister copper said oxidant gas injectors being positioned below the level of white metal and semi-blister copper during operation;

c) a finishing furnace fitted with lance means for oxidant or reductant gas and containing molten copper richer in grade than semi-blister copper stirred from the bottom by an inert gas;

d) first transfer means for transferring matte from said oxygen flash furnace to said converter vessel;

e) second transfer means for transferring molten semi-blister copper from said converter vessel to said finishing furnace;

f) third transfer means for transferring copper product from said finishing furnace;

g) fourth means for transferring siliceous slag from said converter vessel to said oxygen flash furnace;

h) fifth means for balancing the rates of transfer of said first, second and third transfer means to maintain the copper content of said converter vessel at a steady state; and i) an oxidant gas supply for said converter vessel and said finishing furnace.

2. A copper smelting system as in claim 1 in which the oxidant gas in said converter is selected from the group of air, oxygen enriched air and oxygen.

3. A copper smelting system as in claim 2 wherein said first transfer means for transferring matte from said oxygen flash furnace to said converter vessel includes a means for solidifying said matte and delivering solidified matte continuously to said converter, a means for balancing the ratio of solid to liquid matte fed to said converter with the oxygen content of the oxidant gas in said converter to provide for the heat requirements of said converter and a means for delivering molten matte intermittently to said converter.

4. A copper smelting system as in claim 1 wherein said converter vessel includes a means for continuously converting said molten white metal.

5. A copper smelting system as in claim 4 wherein said oxygen flash furnace includes a means for continuously oxidizing said copper sulfide. 1

* * * * *